United States Patent [19]

Newton

[11] 4,361,620

[45] Nov. 30, 1982

[54] TOTAL ENERGY EXCHANGE MEDIUM AND METHOD OF MAKING THE SAME

[75] Inventor: Emerson H. Newton, Arlington, Mass.

[73] Assignee: Wing Industries, Inc., Cranford, N.J.

[21] Appl. No.: 255,562

[22] Filed: Apr. 20, 1971

Related U.S. Application Data

[62] Division of Ser. No. 18,793, Mar. 8, 1979, Pat. No. 4,290,789.

[51] Int. Cl.[3] ..... B32B 5/16

[52] U.S. Cl. ..... 428/341; 428/469; 428/471; 428/701; 427/126.4; 148/6.27

[58] Field of Search ..... 428/471, 697, 701, 341, 428/469; 148/6.27; 427/126.4

[56] References Cited

U.S. PATENT DOCUMENTS

| | | |
|---|---|---|
| 2,038,071 | 4/1936 | Wilhelm . |
| 3,235,089 | 2/1966 | Burroughs . |
| 3,398,510 | 8/1968 | Pennington . |
| 3,664,095 | 6/1972 | Asker et al. . |
| 3,702,156 | 11/1972 | Rohrs et al. . |
| 4,093,435 | 6/1978 | Marron et al. . |
| 4,172,164 | 10/1979 | Meyer et al. . |

FOREIGN PATENT DOCUMENTS

| | | |
|---|---|---|
| 629879 | 10/1961 | Canada . |

*Primary Examiner*—George F. Lesmes
*Assistant Examiner*—Beverly K. Johnson
*Attorney, Agent, or Firm*—Brooks, Haidt, Haffner & Delahunty

[57] ABSTRACT

Total heat energy exchange medium incorporated in an energy exchange device for transferring heat and moisture between two airstreams in an air supply system. The exchange medium is aluminum having a coating of hydrated calcium and aluminum oxides or hydroxides to render its heat transfer surfaces capable of exchanging latent as well as sensible heat energy. The coating is formed by exposing precleaned aluminum to a heated, preferably boiling solution of water-soluble calcium and aluminum compounds, preferably equal parts of hydrated calcium nitrate and hydrated aluminum nitrate, the pH of the solution having been brought to the range of from about 7 to 11, preferably pH=8 to 9, by adding sodium hydroxide which produces in the solution a mixed gelatinous precipitate of hydrated calcium and aluminum oxides and hydroxides. When the aluminum is exposed to this solution, as by immersing the aluminum therein, further reaction with the aluminum forms a conversion coating portion comprising an hydrated calcium aluminate immediately next to the aluminum surface which, in turn, secures the insoluble gel-like precipitate coating portion of hydrated calcium and aluminum oxides or hydroxides thereto.

18 Claims, 3 Drawing Figures

TOTAL ENERGY EXCHANGE MEDIUM AND METHOD OF MAKING THE SAME

This is a division, of application Ser. No. 18,793, filed Mar. 8, 1979, now U.S. Pat. No. 4,290,789.

FIELD OF THE INVENTION

This invention relates to regenerative devices by which moisture and/or latent and sensible heat are exchanged between two streams of fluid, such as between the fresh intake air and exhaust air streams in a make-up air supply system, for the purpose of reducing the amount of heat and moisture as would otherwise be necessary to add to, or take from the incoming air to temper it for use. More particularly, the invention relates to the heat and moisture transfer elements or matrices incorporated in such regenerative devices, and to their fabrication.

Although the present invention may have utility in pile-type or other regenerators for such purposes and to other uses such as in the field of dehumidification, it was made during an attempt to improve the energy exchange medium in a rotary-type regenerative exchanger for use in total heat energy recovery and exchange devices, and will therefore be described in connection with such use.

BACKGROUND OF THE INVENTION

Such a rotary regenerator, commonly referred to as a heat exchange "wheel", is mounted spanning across, and for rotation between adjacent but separate gas supply and exhaust ducts. The wheel is primarily constituted by a gas-permeable matrix or medium through which both the incoming and outgoing streams pass. The matrix is capable of absorbing moisture and/or thermal energy from one gas stream for subsequent release, upon further rotation, into the second gas stream. For instance, if it is desired to heat and humidify an incoming fresh air stream in a building air supply system during the winter season, the wheel abstracts both sensible and latent heat energy from the warmer and moister exhaust air stream which is flowing oppositely in the adjacent exhaust duct by exposing the wheel matrix thereto, whereupon the wheel rotates to expose the matrix area and thus transfer the sensible and latent heat energy to the cooler, drier incoming air flowing in the supply duct. Conversely, in the summer season, there is a need to remove moisture and heat from the incoming air stream for use in the air-conditioned building and, under these circumstances, the matrix first absorbs sensible and latent energy from the incoming air, whereupon the wheel is rotated into the cooler, drier exhaust air stream which absorbs the sensible and latent energy from the wheel matrix and discharges such energy outside the air-conditioned spaces. Thus, the device substantially reduces the amount of heat energy and moisture required to be added to warm the incoming fresh air in wintertime, and the amount of cooling and dehumidification of the fresh air which would otherwise be required in the summertime.

One material which has been used as the heat transfer medium in such total heat energy exchange wheels is asbestos in the form of alternately flat and corrugated asbestos paper sheets which are impregnated with an hygroscopic salt such as lithium bromide or lithium chloride for improved transfer of moisture. Although such heat and moisture exchange media have also been made of cellulosic paper as shown for example in Canadian Pat. No. 629,879 (Munters), or of coated or specially treated paper to remove latent or sensible heat transfer capabilities or to improve strength as shown for example in U.S. Pat. No. 3,664,095 (Asker et al), asbestos has been considered generally superior to paper or other material, at least in terms of the latent heat and moisture exchange rates and efficiencies of comparably sized media. See, for example, U.S. Pat. No. 3,398,510 (Pennington) in which a comparison is made between the characteristics of cellulosic paper and asbestos paper in such wheels, albeit as used for moisture transfer rather than for total heat exchange.

However, for various reasons it is desirable in particular instances of use to provide a total heat energy exchange medium made from material other than asbestos, but whose latent and sensible heat energy exchange efficiencies approximate to those of such impregnated asbestos material. It is an object of the present invention to provide such an alternative heat exchange medium.

It should be noted that all-metal media wheels, formed by spirally winding either stainless steel foil or aluminum foil about a hub as can be seen for instance in U.S. Pat. No. 3,702,156 (Rohrs et al) and Canadian Pat. No. 629,879 (Munters), are commonly employed where it is intended to recover and exchange only sensible heat. Such metal wheels are obviously not capable of recovering and transferring significant latent heat energy or moisture.

Of course, a suitable energy exchange medium or matrix should have not only both latent and sensible heat exchange efficiencies comparable to those of a matrix made of asbestos impregnated with an hygroscopic substance such as lithium chloride, but must also satisfy other requirements of such devices, and it is intended by the present invention to provide such an energy exchange device which meets all such criteria. For example, the device and therefore its energy exchange matrix material and construction must be substantially fire resistant and bacteriostatic, and have adequate strength and erosion resistance for its intended use, such as in an airstream flowing at moderate or even high velocity on the order of from about from about 500 feet per minute (fpm) to about 1000 fpm. It must be convenient to manufacture, and its manfacturing costs should approximate those of an asbestos wheel.

BRIEF DESCRIPTION OF THE INVENTION

Briefly describing the invention in its presently preferred embodiment, a total energy exchange wheel is provided with an energy transfer medium formed of alternately flat and corrugated sheets of aluminum having a conversion-type coating of a complex or mixture of hydrated oxides or hydroxides of calcium and aluminum to render its surface areas capable of transferring latent heat energy as well as sensible heat energy. By "conversion-type coating" is meant a coating whose chemical nature is determined at least in part by the chemical nature of the substrate, in this case aluminum. Thus, the coating is formed on and firmly adhered to the aluminum by chemical reaction with the aluminum surface itself. Aluminum base material is selected because of its inherent high sensible heat transfer capability as well as its other desirable properties, including ease of fabrication into a wound energy exchange matrix.

In the present invention, the calcium-aluminum hydroxide coating is partly pre-formed using hydrated aluminum and calcium nitrates and sodium hydroxide before being applied to the aluminum, and the finally formed coating therefore appears to have a dual structure with a thin, conversion coating portion immediately next to, and formed by further reaction with the aluminum body of the matrix, and a dried-on gel-like surface coating portion forming the remainder of the coating thickness. The coating is quite adherent and abrasion-resistant, and is very water-absorptive at a good rate. The last-mentioned characteristic causes the coated wheel to have a total heat energy transfer effectiveness which is comparable to that of an impregnated asbestos wheel.

The preferred process by which the coating is applied to the aluminum base material in accordance with the invention involves prior cleaning and light etching of the aluminum base metal, and thereafter immersing it in the coating solution. Although it might be done otherwise, the aluminum material is preferably already formed into the wound wheel matrix of alternate flat and corrugated sheets when it is cleaned and coated.

Although various cleaners and cleaning techniques might be used to clean the aluminum material prior to its being coated, in the presently preferred process the aluminum is first steam-cleaned to remove dirt and to pre-heat it for subsequent immersion in the hot alkaline cleaner, preferably a solution of sodium hydroxide in water. After such cleaning the aluminum is rinsed in heated water and again steam-cleaned before immersing in the coating solution.

The preferred coating solution is a slurry of equal parts by weight of soluble hydrated aluminum nitrate and hydrated calcium nitrate in water, to which is added sodium hydroxide to precipitate mixed hydroxides in a gelatinous form. The range of bath composition for forming the coating is approximately:

Aluminum Nitrate.9 $H_2O$: 60 to 120 grams per liter (g/l)
Calcium Nitrate.X $H_2O$ (15 to 15.5% N): 60 to 120 g/l (where X is equal to about 1.0)
Sodium Hydroxide: about 20 to 25 g/l to pH 8.0 to 9.0 of the bath.

The composition of this colloidal gel-like slurry can be changed markedly by changing its pH and therefore, as indicated above, the pH of the starting slurry is regulated to within a range of between about 7.0 and about 11.0, preferably 8.0 to 9.0, by adding more or less of the sodium hydroxide. Although adequate coatings are produced at temperatures from about 175° F. to about 215° F. using immersion times of from five to sixty minutes, the aluminum metal to be coated is preferably immersed in a boiling slurry for from thirty to thirty-five minutes and then withdrawn and permitted to dry without rinsing.

The dual-structure coating thus formed is composed of mixed hydrated oxides and/or hydroxides of calcium and aluminum in which the ratio of calcium to aluminum in the dried coating is from about 1:1 to 2.5:1, and preferably about 2:1. Analysis shows only two crystalline phases present in the dried coating, these being calcite (calcium carbonate) which could be derived from carbonation of calcium hydroxide by carbon dioxide in the air, and aluminum hydroxide, with the remainder of the coating being amorphous, probably a combination of calcium and aluminum hydrated oxides. The conversion portion of the coating comprises a mixture of hydrated calcium and aluminum oxides and/or hydroxides containing an hydrated calcium aluminate which may be formed by reaction of the aluminum substrate with the mixed hydroxides in the coating bath.

It should be understood that the amount of the coating deposited or formed on the surface of the aluminum matrix material can vary over wide limits. For many applications the dried coating weight would vary from about 0.5 to about 3.0 grams of coating per square foot of aluminum matrix material surface, preferably from about 1.5 to 2.5 grams per square foot.

DETAILED DESCRIPTION OF PREFERRED EMBODIMENTS

These and other objects, features, and advantages of the invention will become fully apparent from the following detailed description thereof in which reference is made to the accompanying drawings in which.

Figure 1:
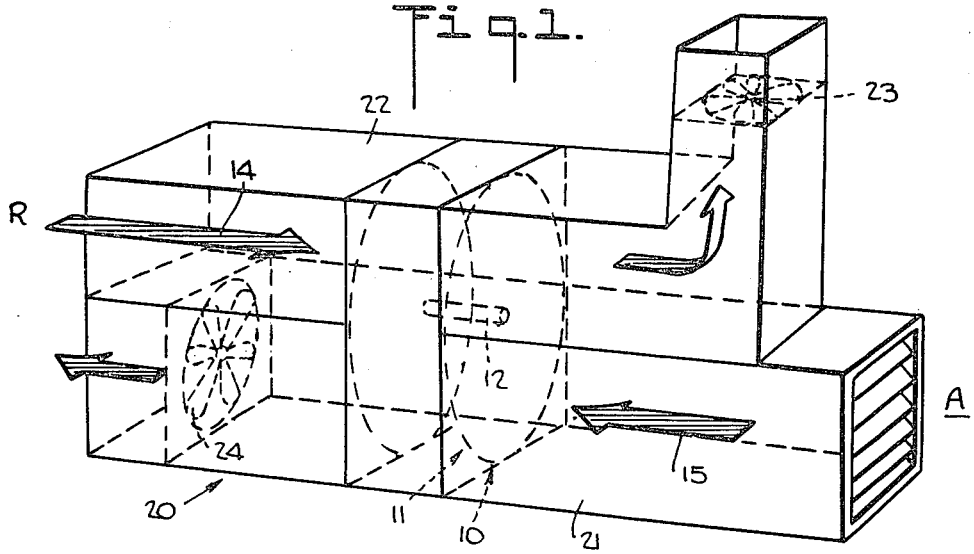
FIG. 1 is a diagrammatic showing of a make-up air supply system having a total heat energy recovery and exchange wheel in accordance with the invention mounted therein.

Referring to FIG. 1, a total heat recovery and transfer device 10 in accordance with the invention is incorporated in a make-up air supply system, generally indicated by reference numeral 20, in a building (not indicated) for continuously introducing fresh ambient air and exhausting stale air. The device 10 includes a total heat energy recovery and exchange wheel generally indicated by dotted lines 11, mounted on a shaft also indicated by dotted lines 12, for rotation spanning across an inlet air duct 21 and an exhaust air duct 22 to transfer both latent and sensible heat energy, accompanied or not by moisture, from the exhaust airstream 14 flowing from a room or the like R to the oppositely flowing fresh air supply airstream 15 from the atmosphere A. A fan 23 induces the flow of the exhaust airstream 14 through the wheel 11, and a fan 24 similarly induces the flow of fresh air 15.

Figure 2:
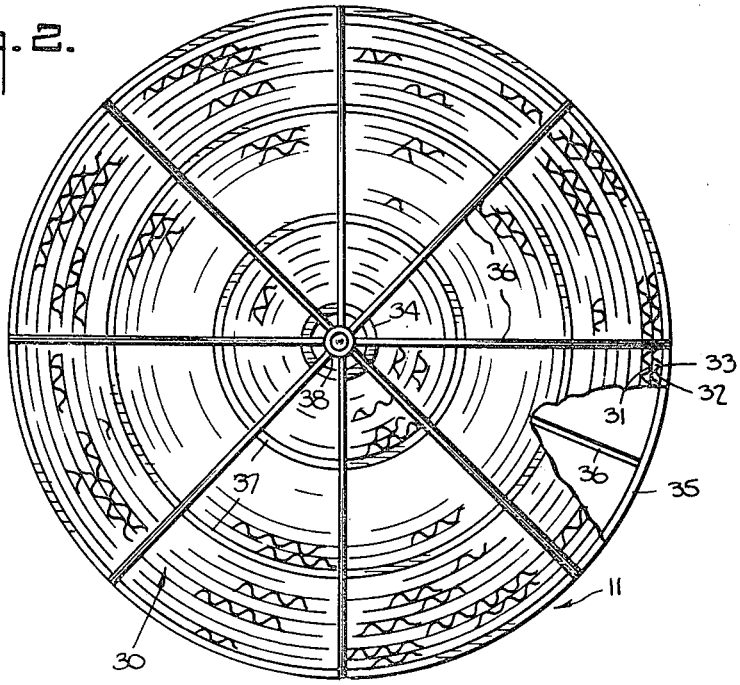
FIG. 2 is a plan view, partly broken away, of a total heat energy recovery and exchange wheel in accordance with the invention.
Figure 3:
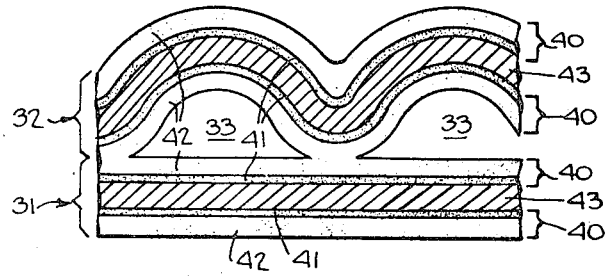
FIG. 3 is a greatly enlarged, fragmentary view in cross-section of the coated aluminum matrix material which is the total heat exchange medium in the device of FIG. 2.

Referring to FIGS. 2 and 3, the wheel 11 includes a total heat energy and moisture transfer medium or matrix generally indicated by reference numeral 30, made of alternate thin sheets of flat coated aluminum material 31 and corrugated coated aluminum material 32 whose open-ended corrugations provide a multitude of parallel passages 33 through the wheel, in the direction of its depth, to permit the flow of air therethrough. The uniform height of the corrugations is such as to provide a passage diameter of from about 0.06" to 0.12" in the completed wheel. The alternate flat and corrugated sheets or strips are spirally wound on a cylindrical metal winding hub 34 until the desired wheel diameter is reached. An outer peripheral metal rim 35 is formed around the winding, the depths of the winding hub 34, media 30, and outer rim 35 preferably being equal so that the respective end faces of the wheel 11 are flush.

In a common construction, at each of its end faces the wheel has a plurality of angularly spaced apart, radially extending metal spokes 36 which retain the medium 30 in place and further rigidify the wheel structure as a whole. The exposed edges of the spokes 36 also lie within the planes of the respective end faces. The illustrated embodiment has sixteen such spokes, eight on each side of the wheel, attached between the winding hub 34 and peripheral rim 35, although fewer or more spokes can be used. Each spoke is 3/16" steel, four inches deep, and is placed within a correspondingly sized groove extending radially across the medium 30, the steel hub 34 and steel peripheral rim 35, which are also grooved to receive the spokes. Each spoke 36 is affixed solidly, as by welding to the peripheral rim 35, hub 34, and any intermediate bands 37 which it crosses. Regarding the latter, where the outside diameter of the wheel will be more than about 36 inches, the continuous winding of the corrugated and flat aluminum strips can be terminated and an annular steel band 37, also having width equal to that of the rim 35, is wrapped tightly therearound and secured, as by welding, at a radial location out from the periphery of the hub 34. As shown in the drawing, the wheel can have a plurality of such intermediate annular metal bands 37, each being similarly attached about successive windings of the corrugated material at additional radial locations until the full diameter of the wheel, which may be twelve feet or more, is attained. The spokes also extend and are welded to an inner cylindrical hub 38 by which the wheel is mounted for rotation on the shaft 12 (FIG. 1). A motor (not shown) of the device 11 drives the wheel at a relatively slow speed, not higher than about 40 revolutions per minute (rpm).

As previously pointed out, the present invention provides a total heat energy exchange medium 30 formed by spirally wound flat coated aluminum material 31 and corrugated coated aluminum material 32. Moreover, the coating 40 which is formed on all exposed surfaces of the corrugated and flat sheet aluminum is actually dual-structured, as indicated by the thin conversion coating portion 41 thereof which is derived by reaction of the coating slurry (as will be described) with the aluminum base material 43, and a dried on gel-like coating portion 42 on the surface.

The coating 40 is not only very adherent to the aluminum but is very water absorptive, such that it is a highly effective transferrer of latent heat energy. The aluminum base material 43 is an excellent transferrer of sensible heat energy and, therefore, the coated aluminum medium 30 will recover and transfer both latent and sensible heat energy between two airstreams in the desired manner.

Turning now to the composition and manner of forming the coating 40 on the aluminum base material 43, it should first be noted that the aluminum 43 to be treated is generally in the form of sheets having the thickness necessary to form the corrugated or other structure defined hereinbefore. Generally, the aluminum may range in thickness from 2.5 to as much as 50 mils (thousands of an inch), but in the preferred embodiment its thickness is 3 mils. Numerous grades of aluminum can be utilized, and the coating 40 can be formed on a wide variety of aluminum alloys.

In general, the aluminum surface should be free of grease, oil, and other surface contaminants to promote the chemical reaction and therefore the adherence between the metal and the coating. Accordingly, the metal surface can be mechanically cleaned as by sandblasting or the like, or steam-cleaned, or it can be cleaned with organic solvents such as lower hydrocarbons, like hexane, octane, and isooctane. Such pretreatments can also be used in combination.

However, a preferred pretreatment according to the present invention comprises first steam cleaning, and then immersing the aluminum surface in an aqueous alkaline bath, which lightly etches the surface. While lithium and potassium hydroxides can be used to provide satisfactory results, reasons of cost and superior results make sodium hydroxide a preferred alkaline pretreatment agent. For pretreatment purposes, the quantity of alkaline material in the bath should be adequate to clean and provide a light caustic etching of the aluminum surface, but should not be so powerful as to consume any substantial portion of the aluminum. It has been found that pretreatment baths containing up to about 40 g/l of sodium hydroxide can be used, although the preferred solution has 12 g/l concentration. The relatively dilute 12 g/l solution heated to 120° F. produces adequate cleaning and light etching after two, one-minute immersions of the aluminum.

After such pretreatment, the metal is rinsed in warm water, either in a rinse tank or by running the water over the cleaned surfaces, and is then coated.

Although a variety of soluble organic and inorganic calcium and aluminum materials might be used to form the coating solution, nitrates are preferred because nitrates are not corrosive to aluminum. Thus, calcium nitrate and aluminum nitrate are especially preferred as the soluble compounds to form the gelatinous precipitate, these compounds also being economical, and providing ease of waste disposal. The latter underscores another advantage obtained according to the presently preferred embodiment of the invention: The wastes left after the treatment are not noxious, and present no disposal problem.

The preferred coating bath is prepared by dissolving hydrated aluminum and calcium nitrates in water and precipitating aluminum and calcium hydroxides using sodium hydroxide. The bath therefore is two-phase, the liquid phase containing all of the nitrate and sodium ions while the calcium and aluminum are present in both the liquid and the precipitate. Since the solubilities of calcium and aluminum hydroxides vary with pH, the relative amounts in each phase will also vary. At low pH (7–9) calcium hydroxide is more soluble than at higher pH (10–11). The reverse is true of aluminum hydroxide and at even higher pH (12–13) aluminum hydroxide dissolves to form the aluminate ion $AlO_2^-$. Thus, in the preferred lower range of pH 7 to 9, the precipitate contains considerably more aluminum hydroxide and considerably less calcium hydroxide.

Good results have been obtained with Ca/Al atomic ratios of from 1:1 to 4:1. In certain embodiments, it is preferred that the Ca/Al ratio be from 2:1 to 3:1. As previously mentioned, in a presently preferred embodiment equal weights of hydrated calcium nitrate and hydrated aluminum nitrate are dissolved in water, which provides a Ca/Al ratio of 2.98:1.

The concentraton of the soluble salts in the aqueous solution can be varied over a wide range. When the solutions are too dilute, the precipitate is sparse and the process becomes inefficient. On the other hand, operation at or beyond the point of saturation of the soluble compounds complicates the process and increases the cost. It is accordingly desirable that the solutions contain concentrations of from about 50 g/l to about 120 g/l of each of the two soluble components. In the aforementioned preferred embodiment, the concentration of each added component is about 76.7 g/l (0.64 pounds per gallon).

After the solution of calcium and aluminum nitrates is prepared, the alkali is added to form the gelatinous precpitate. The preferred sodium hydroxide concentration is about 20 to 25 g/l, to bring the pH of the coating bath to from about 8.0 toabout 9.0. The thus formed coating bath is heated to at least 175° C., and in the preferred embodiment is brought to a boil.

After the gelatinous precipitate has been formed in the bath as described, the surface of the aluminum, cleaned and rinsed as previously described, is exposed to the coating bath, preferably by immersing the fully formed wheel 11 therein. The coating 40 as it forms on the aluminum surface upon its exposure to the bath, can be considered a precipitate, but is believed more properly characterized as a combination precipitate and conversion coating, both portions of the coating comprising calcium and aluminum hydroxides and/or oxides, and the conversion portion or layer further comprising an hydrated calcium aluminate. In any event, the coating 40 when formed is not very thick, but is quite durable.

The time of immersion of the wheel in the boiling coating bath can range anywhere from 5 to 60 minutes. In many embodiments, the coating is substantially completely formed in from 10 to 20 minutes. However, in the presently preferred embodiment, the aluminum is immersed in the boiling slurry for from about 30 to 35 minutes. After the coating has formed on the surface of the aluminum substrate the matrix is removed from the bath and allowed to drain, and if preferably dried with a flow of warm air. When dry, the resulting coating is very adherent and has excellent abrasion resistance. As previously noted, the coating will both absorb and release moisture readily under different ambient conditions, and an aluminum wheel which is so coated will therefore recover and transfer both latent and sensible heat energy with high efficiencies, comparable to those of asbestos.

To indicate the effects of variaton of coating bath composition, including its pH coating temperature, and duration of exposure of the aluminum to the coating bath composition, results obtained upon variation of one or more of these factors will now be described. Reference will be made to the coating of small aluminum test panels, and the coating of test wheels formed of wound alternate flat and corrugated aluminum sheets. In some instances as will be noted, the wound wheel diameter was 8 inches, whereas in other instances it was 38 inches. In all cases, the aluminum material was 3 mil thick aluminum sheet.

The relative moisture absorbing power of the resulting coating was determined in some cases, as will be indicated, by a simple water drop test. In this procedure a single drop of deionized water was placed on the coated aluminum panel held horizontally, and the diameter of spread of the water drop within a fixed time period was noted. Such is believed to be a qualitative indication of the absorbing power of the coating, and is useful in comparing coatings made under various conditions. Heat recovery efficiencies of wheels were determined by a conventional technique involving air velocity measurements and wet and dry bulb temperature measurements as known to those skilled in the art.

Coatings on Aluminum Panels

In a first experiment, two calcium aluminum hydroxide slurries were made up using the following quantities:

| | Solution No. 1 | Solution No. 2 |
|---|---|---|
| Calcium nitrate, g/l | 57 | 100 |
| Aluminum nitrate, g/l | 91 | 80 |
| Ca/Al ratio | 1.93 | 3.86 |
| Sodium hydroxide, to pH | 10.5 | 8 |

Aluminum panels were immersed in the boiling slurry for from 15 to 30 minutes, removed and dried without rinsing. The resulting white coatings made in either bath were quite adherent and very water absorptive.

The results of further experiments on similar aluminum panels, carried out at several concentrations of aluminum and calcium nitrates at various pH levels, immersion times and temperatures are recorded in Tables 1 and 2.

TABLE 1

DATA ON Ca—Al HYDROXIDE COATINGS AT TWO CONCENTRATIONS AND FOUR pH LEVELS
All Coatings Made at Boiling Temperatures for 30 Minutes
Ratio Ca/Al in all baths as made up = 2.98

| Sample No. | Original Concentration of each of $Ca(NO_3)_2.XH_2O$(15.5% N) and $Al(NO_3)_3.9H_2O$ in bath lbs./gal. | pH of Baths Start-End | Coating Weight on Panels g/ft$^2$ | % Ca in Coating | % Al in Coating | Ratio Ca/Al | Water Drop Test: Diameter after 1 min, 16th inch | Water Drop Test: Diameter after water drop had dried |
|---|---|---|---|---|---|---|---|---|
| 1A | 0.5 | 8.1-7.4 | 1.67 | 7.49 | 5.76 | 1.30 | 12 | 17 |
| 2A | 0.5 | 9.1-7.7 | 2.55 | 9.01 | 4.98 | 1.81 | 15 | 21 |
| 3A | 0.5 | 10.0-9.3 | 1.65 | 7.76 | 7.04 | 1.10 | 15 | 19 |
| 4A | 0.5 | 11.0-9.9 | 1.30 | 8.14 | 6.61 | 1.23 | 19 | 24 |
| 1B | 1.0 | 8.0-7.4 | 0.70 | 7.76 | 6.26 | 1.24 | 19 | 23 |
| 2B | 1.0 | 9.0-8.1 | 0.81 | 7.94 | 6.74 | 1.18 | 20 | 25 |
| 3B | 1.0 | 10.0-8.8 | 0.90 | 8.02 | 7.87 | 1.02 | 20 | 24 |
| 4B | 1.0 | 11.0-9.8 | 0.88 | 8.47 | 6.83 | 1.24 | 19 | 22 |

TABLE 2

COATINGS AT VARIOUS TIMES AND TWO TEMPERATURES
ALL COATINGS MADE USING SAME BATH COMPOSITION
Hydrated Aluminum nitrate - 0.64 lbs./gal.
Hydrated Calcium nitrate - 0.64 lbs./gal.
Sodium hydroxide - to pH 9.0
Ratio Ca/Al = 2.98

| Time of Immersion min. | Weight of Coating g/18 in$^2$ | Weight of Coating g/ft$^2$ | % Ca | % Al | Ratio Ca/Al | Diametral Spread of 1 drop of water, 2 min. 16th - in. | Coating Adherence |
|---|---|---|---|---|---|---|---|
| COATINGS MADE AT BOILING TEMPERATURE | | | | | | | |
| 5 | .1344 | 1.08 | 6.10 | 6.57 | 0.93 | 16 | Very Poor |
| 10 | .2305 | 1.84 | 7.25 | 6.50 | 1.12 | 16 | Fair |
| 15 | .1632 | 1.31 | 5.62 | 8.15 | 0.69 | 17 | Fair |
| 20 | .1702 | 1.36 | 5.29 | 9.89 | 0.53 | 16 | Poor |
| 25 | .2315 | 1.85 | 7.16 | 7.65 | 0.94 | 17 | Good |
| 30 | .1668 | 1.33 | 5.55 | 9.08 | 0.61 | 18 | Good |
| 35 | .2949 | 2.36 | 7.21 | 6.85 | 1.05 | 18 | Good |
| 40 | .2114 | 1.69 | 7.10 | 8.10 | 0.88 | 16 | Good |
| 45 | .1708 | 1.37 | 5.36 | 9.81 | 0.55 | 14 | Good |
| 50 | .1170 | 0.94 | 4.55 | 11.62 | 0.39 | 16 | Poor |
| 55 | .1953 | 1.56 | 5.35 | 9.50 | 0.59 | 16 | Good |
| 60 | .2144 | 1.72 | 6.80 | 8.70 | 0.78 | 12 | Good |
| COATINGS MADE AT 175° F. | | | | | | | |
| 5 | .0484 | 0.39 | 7.02 | 2.01 | 3.49 | 12 | Very Poor |
| 10 | .1230 | 0.98 | 6.75 | 4.35 | 1.55 | 12 | Poor |
| 15 | .2394 | 1.92 | 7.92 | 4.15 | 1.91 | 14 | Fair |
| 20 | .2211 | 1.77 | 7.91 | 4.41 | 1.79 | 14 | Good |
| 25 | .0853 | 0.68 | 6.98 | 5.95 | 1.17 | 16 | Fair |
| 30 | .3020 | 2.42 | 8.20 | 5.47 | 1.50 | 12 | Good |
| 35 | .1995 | 1.60 | 7.43 | 6.47 | 1.15 | 13 | Good |

Note:
Coverage was non-uniform in the first 15 minutes in all cases.

In the series reported in Table 1, two concentrations, 0.5 and 1.0 pounds per gallon of each nitrate, were tested at four pH levels 8, 9, 10 and 11. Aluminum panels were treated in the 8 baths for 30 minutes at boiling temperatures. The lower concentration bath produced heavier coating, but no consistent trend of coating weight and calcium-aluminum ratio seems evident with change in pH from 8 to 11. The maximum water absorption as measured by the rate of spread of a water drop was observed on panels coated in the more concentrated bath at pH 9 and 10.

In the other series of experiments (Table 2) the effects of time of immersion and coating temperature were explored in a boiling bath containing 0.64 pounds of hydrated calcium and aluminum nitrates per gallon at pH 9.0. No consistent trend in coating weight was noted after the first 5 minutes. The differences in coating weight and calcium-aluminum ratio are due to varying amounts of gelatinous film clinging to the panel as it is removed.

The rate of spreading of a water drop appears unrelated to coating weight, although a coating time of 30 to 35 minutes appears optimum at boiling temperature. Coatings made at 175° F. appear to be less effective than those made at boiling temperatures.

In a third series of experiments the effect of varying the ratio of calcium to aluminum in the coating bath was explored, the results being shown in Table 3. Four one-liter baths were made up containing ratios of calcium to aluminum of 1, 2, 3 and 4 holding the aluminum nitrate constant at 76.7 g/l. All baths were operated at boiling temperatures and a pH of 9.0. Three 4"×4" aluminum panels were processed in each bath, one each at 10, 20 and 30 minutes. After drying the panels overnight at room temperatures, the spread of water drops on each sample was determined at intervals up to 15 minutes.

TABLE 3

WATER DROP SPREADING TESTS ON 4" × 4" ALUMINUM PANEL SAMPLES IN BATHS WITH VARIOUS Ca/Al RATIOS

| Panel No. | Ca/Al Ratio in Bath | Coating Time, Min. | Average Diameter of Water Drop, mm, After 0.5 min | 2 min | 5 min | 15 min (dried) |
|---|---|---|---|---|---|---|
| 1 | 1 | 10 | 15 | 27 | 35 | 36 |
| 2 | 2 | 10 | 14 | 21 | 35 | 40 |
| 3 | 3 | 10 | 11 | 14 | 18 | 18 |
| 4 | 4 | 10 | 11 | 16 | 22 | 31 |
| 5 | 1 | 20 | 13 | 21 | 36 | 44 |
| 6 | 2 | 20 | 10 | 20 | 25 | 34 |
| 7 | 3 | 20 | 12 | 16 | 20 | 22 |
| 8 | 4 | 20 | 11 | 18 | 27 | 34 |
| 9 | 1 | 30 | 17 | 29 | 44 | 46 |
| 10 | 2 | 30 | 16 | 24 | 33 | 40 |
| 11 | 3 | 30 | 11 | 16 | 21 | 26 |
| 12 | 4 | 30 | 12 | 18 | 23 | 27 |

With one exception the panels made in baths having Ca/Al ratios of 1 or 2 have wider spreading of water drops at equivalent times than panels with Ca/Al ratios of 3 and 4. The best result appears to be achieved on a panel treated for 30 minutes in a bath containing an equal amount of calcium and aluminum even though this is also the most dilute. Such indicates the preferred bath composition and time of immersion.

Coatings on 8-Inch Diameter Test Wheels

Four 8-inch diameter aluminum test wheels were coated by the process as noted in Table 4. The same solution was used in coating Wheels 1 and 2. A new solution of the same composition was made up and used on Wheels 3 and 4. The wheels were rinsed in warm water after cleaning, but not after coating. The excess solution remaining in the wheel on removal from the bath was partially shaken out. Some of the remaining moisture was blown out with a stream of cold air, and the coating was allowed to dry at room temperature. The heat recovery efficiencies of Wheels 1, 3 and 4 were very similar and quite stable at all humidities. The peculiar behavior of Wheel 2 in reversng the usual trend of lower efficiency at high humidity is unexplained.

Referring to Wheel 3 in Table 4 which had good heat recovery efficiencies, a flat aluminum test panel was coated in the same bath simultaneously with the wheel, and both the weight of the dried coating and the ratio of calcium to aluminum in the dried coating were determined, the presumption being that the coating on Wheel 3 has the same coating weight and Ca/Al ratio. The coating weight on the dried test panel was 2.256 grams per square foot, and its Ca/Al ratio was 2.04.

TABLE 4

COATINGS ON FOUR 8" ALUMINUM TEST WHEELS

| Wheels Cleaned Using Following Cleaners and Procedures: | | | |
|---|---|---|---|
| Wheel 1 | Wheel 2 | Wheel 3 | Wheel 4 |
| Sodium metasilicate: | 45 g/l | Wyandotte BN Metal | |
| Sodium hydroxide: | 4 g/l | Cleaner: 45 g/l | |
| Temperature: | Temperature: | Temperature: | |
| 175–180° F. | 150° F. | 160–170° F. | |
| Immersion Time: | Immersion Time: | Immersion Time: | |
| 2 minutes | 10 2-sec. dips | 5 to 10 minutes | |

Wheels Coated Using Following Bath Compositions and Procedures:
Calcium nitrate 77 g/l (0.64 lbs./gal.)
Aluminum nitrate 77 g/l (0.64 lbs./gal.)
Sodium hydroxide 25 g/l (0.21 lbs./gal.)

| | Wheel 1 | Wheel 2 | Wheel 3 | Wheel 4 |
|---|---|---|---|---|
| pH: | 9.0 | 9.5 | 9.0 | 9.1 |
| Immersion Time: | 35 min. | 35 min. | 35 min. | 35 min. |
| TEMPERATURE PROFILE IN COATING BATH | | | | |
| Min. | °F. | °F. | °F. | °F. |
| 0 | 215 | 214 | 214 | 214 |
| 2 | 208 | 208 | 212 | 210 |
| 5 | 210 | 209 | 210 | 211 |
| 10 | 214 | 212 | 212 | 212 |
| 15 | 214 | 213 | 213 | 212 |
| 20 | 214 | 214 | 214 | 213 |
| 25 | 214 | 214 | 214 | 213 |
| 30 | 215 | 214 | 214 | 214 |
| 35 | 215 | 214 | 214 | 214 |
| HEAT RECOVERY EFFICIENCIES | | | | |
| Low Humidity | 76% | 38% | 71% | — |
| Medium Humidity | 85 | 55 | 69 | 68 |
| High Humidity | 73 | 68 | 67 | 68 |

Coatings on 38-Inch Diameter Wheels

Two 38-inch diameter production type wheels were coated by the process under conditions similar to those used on the 8-inch diameter test wheels (Table 4). Processing was carried out in 3–48" diameter—24" high steel tanks fabricated from 1/16" thick plate. The three tanks were filled half way with 100 gallons of cleaner, rinse water and coating solutions. The solutions were heated by means of steel pipe steam coils laying on the bottom of each tank. Each 38-inch diameter wheel was held in a horizontal position on a 3-legged welded pipe holder and moved from tank to tank by an electric chain hoist.

The first wheel was cleaned in a hot alkaline cleaner composed of 25 lbs. each of Wyandotte BN Cleaner and sodium hydroxide in 100 gallons of solution. The cleaner temperature was about 160° F. Before immersing the wheel in the cleaner it was blasted with live steam to remove any dirt or soil and to heat it up to near cleaner temperature. However, this cleaner composition was so caustic and so hot that the large volume of foam formed by reaction of the aluminum with caustic soda caused the solution to overflow the tank in only a few seconds. The wheel was removed as fast as possible and further cleaning was done by cooling the solution and alternately immersing and removing the wheel about five times. After cleaning, the wheel was rinsed in the next tank, steam blasted on removal, and immersed in the vigorous boiling coating solution for 35 minutes. The solution composition was the same as used on the 8-inch diameter wheels, 64 lbs. each of aluminum and calcium nitrates and 20 lbs. of sodium hydroxide in 100 gallons of solution. The solution was made up the previous day and boiled for an hour before cooling. Just before coating the wheel the pH was adjusted with sodium hydroxide to 9.2. On removal from the coating bath the wheel was allowed to drain for a few minutes, after which the excess liquid was removed. The wheel was allowed to dry for several hours. The heat recovery efficiencies for this wheel under a high humidity condition (0.021 lbs. moisture per pound of dry air) are 70% sensible heat recovery and 71% latent heat recovery in an air stream flowing at medium velocity. These values are similar to the total heat recovery efficiencies for the four coated 8-inch wheels at high humidity (67–73%.

Before processing the second 38-inch diameter wheel, the coating solution was brought back to its original composition by adding 1088 grams (2.4 lbs.) of calcium nitrate, 680 grams (1.5 lbs.) of aluminum nitrate and 200 grams (0.44 lbs.) of sodium hydroxide. The pH was somewhat high 9.9, and 50 ml. of nitric acid was added to bring it down to 9.8. Samples were taken of the bath before and after coating.

In processing the second wheel only the 100 gallon cleaner tank and 100 gallon coating tank were used. Rinsing after cleaning was done by running water through the wheel. The cleaning procedure was carried out in essentially the same manner as the first wheel except the cleaner was composed of 10 lbs. of sodium hydroxide only, and was operated at 120° F. The dilute cleaner (12 g/l) again reacted with aluminum but much slower so that the foaming could be controlled by removing the wheel after one minute of immersion. Two immersions were sufficient to clean and lightly etch the wheel, and therefore this cleaning technique is presently preferred. After rinsing and cleaning, the wheel was immersed in the boiling bath for 35 minutes. On removal from the bath the excess liquid was removed, and the wheel was allowed to dry in a horizontal position.

A more effective drying procedure might be to rotate the wheel in the vertical position and pass warm air through it. This method should retain more of the coating in the wheel and provide better control over the coating thickness and distribution.

The heat recovery efficiencies for the second 38" wheel under the same high humidity condition in the same medium velocity air stream were 70% sensible heat recovery and 50% latent recovery. The reason for the lower latent heat recovery on this second wheel is not clear. It may be related to several factors such as: higher pH (9.8 vs. 9.2), the differences in drying technique which might affect the amount of gelatinous precipitate adhering to the wheel, and/or aging of the bath with resulting subtle changes in composition of the bath and coating. A test panel of flat sheet aluminum coated in the same bath concurrently with the second wheel had a coating weight of 1.69 grams of dried coating per square foot of aluminum surface area.

It should be noted that such latent heat transfer coatings might also be formed on aluminum mesh or aluminum wool matrices which are commonly employed as alternatives to wound corrugated sheet aluminum matrices in such total energy exchange wheels.

Thus, the invention has been described in several embodiments which achieve all of its objects.

What is claimed is:

1. A total energy exchange medium comprising aluminum having an adherent moisture-absorbing coating thereon, said coating having a dual structure and comprising hydroxides or hydrated oxides of calcium and aluminum.

2. A total energy exchange medium according to claim 1, wherein said coating comprises a conversion coating portion on said aluminum, and a gelatinous coating portion on said conversion coating portion.

3. A total energy exchange medium according to claim 2, wherein said conversion coating portion comprises an hydrated calcium aluminate.

4. A total energy exchange medium according to claim 2, wherein said conversion coating portion and said gelatinous coating portion each comprises a mixture of hydrated calcium and aluminum oxides.

5. A total energy exchange medium according to claim 1, wherein the ratio of calcium to aluminum in said coating is from about 1:1 to about 2.5:1 on a weight-to-weight basis.

6. A total energy exchange medium according to claim 5, wherein said ratio of calcium to aluminum is substantially 2:1.

7. A total energy exchange medium according to claim 1, wherein the weight of said coating on said aluminum is from about 0.5 to about 3.0 grams of coating per square foot of aluminum surface.

8. A total energy exchange medium according to claim 7, wherein said coating weight is from about 1.5 to about 2.5 grams per square foot.

9. A process for preparing a total energy exchange matrix which comprises forming a latent energy exchange coating having a dual structure on the surfaces of aluminum substrate material by preparing a solution containing water-soluble calcium and aluminum salts and bringing the pH of said solution to the range of from about 7 to 11 to form a gelatinous precipitate, and exposing the surfaces of said aluminum material to the precipitate.

10. A process according to claim 9 wherein the atomic ratio of calcium to aluminum in said solution is from about 1:1 to about 4:1.

11. A process according to claim 1 wherein the pH is brought into the range of about 7 to 11 with an alkali metal hydroxide.

12. A process according to claim 11 wherein the alkali metal hydroxide is sodium hydroxide.

13. A process according to claim 12 wherein the pH is brought to a value between about 8 to about 9.

14. A process according to claim 9 wherein the temperature of said solution during exposure of said aluminum surfaces to the gelatinous precipitate is from about 160° F. to the boiling point of the solution.

15. A process according to claim 9 wherein said calcium salt is calcium nitrate and said aluminum salt is aluminum nitrate.

16. A process according to claim 15 wherein said calcium and aluminum nitrates are hydrated nitrates, and the concentration of each in said solution is from about 50 to about 120 grams per liter.

17. A process according to claim 16 wherein the aluminum surface is exposed to the gelatinous precipitate for from about 5 to 60 minutes.

18. A process according to claim 9 wherein said calcium and aluminum salts are equal parts by weight of hydrated calcium and aluminum nitrates, the pH of said solution is brought to the range of from about 8 to about 9 by adding sodium hydroxide, the temperature of said solution is maintained at substantially its boiling temperature, and said aluminum surfaces are exposed to said gelatinous precipitate for from about 20 to about 35 minutes.

* * * * *

UNITED STATES PATENT AND TRADEMARK OFFICE

CERTIFICATE OF CORRECTION

PATENT NO. : 4,361,620

DATED : November 30, 1982

INVENTOR(S) : Emerson H. Newton

It is certified that error appears in the above-identified patent and that said Letters Patent are hereby corrected as shown below:

Title Page, Item "[22]", correct filing date to read --Apr. 20, 1981--.

Col. 2, line 3, change "remove" to --improve--;

, line 18, after "approximate", delete "to";

Col. 7, line 4, change "175°C." to --175°F.--;

Col. 11, Table 4, under "TEMPERATURE PROFILE IN COATING BATH", column 5, line 6, change "213" to --212--.

Col. 12, line 28, after "(67-73%", close parenthesis.

Signed and Sealed this

Twelfth Day of July 1983

[SEAL]

Attest:

GERALD J. MOSSINGHOFF

Attesting Officer

Commissioner of Patents and Trademarks